United States Patent [19]

Stone

[11] 4,398,632

[45] Aug. 16, 1983

[54] HANDLE FOR CARRIER

[75] Inventor: Orison W. Stone, Middlebury, Vt.

[73] Assignee: Pack Image, Inc., Middlebury, Vt.

[21] Appl. No.: 290,945

[22] Filed: Aug. 7, 1981

[51] Int. Cl.[3] ..... B65D 75/56; B65D 5/46; B65D 85/62

[52] U.S. Cl. ..... 206/427; 206/165; 206/166; 229/52 BC; 229/52 B

[58] Field of Search ..... 206/427, 162, 180, 141, 206/165, 166; 229/52 BC, 52 B, 28 BC

[56] References Cited

U.S. PATENT DOCUMENTS

| | | | |
|---|---|---|---|
| Re. 29,063 | 12/1976 | Graser . | |
| 2,435,178 | 1/1948 | Marshall . | |
| 3,511,434 | 5/1970 | Dews . | |
| 3,531,042 | 9/1970 | Atkinson . | |
| 4,034,852 | 7/1977 | Forrer . | |
| 4,240,546 | 12/1980 | Stone | 206/427 |
| 4,243,171 | 1/1981 | Prin | 229/52 B |
| 4,284,195 | 8/1981 | Champlin | 206/427 |

FOREIGN PATENT DOCUMENTS

| | | | |
|---|---|---|---|
| 958006 | 3/1950 | France | 229/52 B |

*Primary Examiner*—William T. Dixson, Jr.
*Attorney, Agent, or Firm*—Wood, Herron & Evans

[57] ABSTRACT

An improved carrier for bottles is formed from a paperboard tube having top, bottom and end walls. Parallel fold lines in the top wall of the tube provide a thin flattened ridge at the top of the handle portion of the assembled carrier. Flaps within hand opening cut-outs are folded in and upwardly between the major center panels forming the center partition of the carrier, the lateral cut edges of the flaps bearing against the ridge of the carrier, thereby adding strength in the handle portion. A fold line in one flap presents a flattened surface in the upper portion of the hand opening upon assembly of the carrier, affording greater comfort in carrying the carrier, and cooperates with the aforementioned flattened ridge to form a beam structure which greatly increases the strength of the handle portion of the carrier.

9 Claims, 3 Drawing Figures

HANDLE FOR CARRIER

BACKGROUND OF THE INVENTION

This invention relates to a carrier for articles, usually bottles, and more particularly, to an improved handle portion for a basket-type carrier designed for glass bottles.

In general, a basket-type carrier has a bottom wall, side and end walls, a center partition, and transverse dividers which form cells on each side of the center partition. Since I.C.C. regulations require that bottles be separated from each other by a minimum of 0.04 inches (40 point) thickness of board, it is customary to manufacture the carrier from a blank of 21 point board, and design the carrier so as to provide double thicknesses of board in those areas which space the bottles apart.

These carriers typically provide a thin planar handle portion consisting of a simple opening formed on the upper portion of a central partition of the carrier through which the fingers of a hand can be inserted. Several board plies are arranged at least in the upper portion of the central partition to form a thicker and therefore stronger region surrounding the handle portion; the reinforcing extra plies are ordinarily glued to the plies forming the central partition. The handle portion thus consists essentially of a hand opening which has been formed in these multiple layers of board.

This type of thin handle construction is subject to an unfavorably distributed amount of tension from vertical pull as well as an increased degree of fatigue due to flexion from lateral torques. That is, the vertical tension or load bearing force applied to the handle when the carrier is lifted and carried is transmitted largely through the area immediately above the lateral ends of the hand opening. Likewise, lateral twisting or angular motion about the vertical axis of the carrier will result in flexion stresses in the same immediate area of the hand opening. The result is an increase in fatigue and wear in this region of the handle. Further, a thin interior surface edge is also presented in the hand opening of a carrier of this type which will tend to "bite" into the hand of an individual carrying a loaded carrier, causing discomfort and difficulty in handling the carrier.

An improved bottle carrier of the basket-type is shown in my U.S. Pat. No. 4,240,546. The carrier is first formed as a tube having a bottom wall, end walls and a top wall. The upper four corners of the tube are provided with a gusset structure consisting of triangular gusset panels taken from the end wall. The apexes of the gusset panels are spaced from each other at the central portion of the top wall in order to create a sculptured effect, and to provide ready removability of full or empty bottles from the carrier.

In assembly, the two sides of the top wall of the '546 carrier are folded downwardly through approximately 90° to form a two-ply center partition. The two major center panels of the partition are folded on a center fold line which does not extend all the way to each end wall. The ends of the fold line cooperate with the apexes of the gusset structure at each end of the carrier to form a curved triangular section thereby imparting to the upper portion of the carrier a three-dimensional, sculptured appearance. The center partition structure as described above has several additional advantages. It provides a degree of bracing and rigidity to the carrier, and the downwardly-curving triangular sections reduce the height of the carrier at its end walls by about three quarters of an inch. The full depth center partition further provides double-thickness protection between the two rows of bottles, and more particularly, the bottles at the corners are cushioned by virtue of the maintained spacing apart of the major center panels by the triangular sections. The center partition also distributes the load bearing more evenly down the end walls of the carrier to the bottom wall.

SUMMARY OF THE INVENTION

An objective of the present invention has been to provide an improvement upon the carrier described in the '546 patent, as well as an improved hand portion for paperboard carriers in general. The improvement strengthens the handle portion of the carrier against vertical pull as well as lateral torques, while also adding a greater degree of comfort in carrying the loaded carrier.

More particularly, the improvement is in the formation of a beam-type structure in the handle portion of the carrier. The improvement rests in part in the formation of parallel fold lines across the center line of the top wall of a paperboard tube made from a carrier blank; when the wall is folded downwardly on either side of the center line, a narrow ridge of approximately ¼ inch width is formed. This flattened ridge extends between the apexes of the triangular shaped portions of the handle portion in the '546 type of carriers.

Flaps are partially cut from the blank to form elongated apertures, with each flap hinged to the side of the respective aperture nearest the center line of the top wall. In assembly, the flaps are folded in and upwardly between the two portions of the top wall forming the major center panels of the center partition. The lateral cut edges of the flaps are made to bear against the interior surface of the narrow ridge of the carrier, thus significantly increasing the strength of the handle portion by effectively doubling the thickness of board in this area. No supplemental gluing is needed to maintain the flaps in this relationship.

In addition, a lengthwise crease is made in one of the flaps such that when the flap is folded as described above, a ¼ inch flat surface is presented in the upper portion of the hand opening. This surface is perpendicular to the major center panels forming the center partition, and extends beneath and parallel to the top ridge of the carrier.

The narrow ridge formed from the parallel fold lines in cooperation with the flat surface presented by the creased flap serves to space the two major center panels forming the center partition apart from each other thereby creating, in cross section, a box-beam structure. The box-beam structure thus formed adds a greater degree of strength to the handle portion, compared to the thin layered handle of current manufacture. The planar interior surface of the handle presented by the creased flap also greatly increases comfort in carrying a loaded carrier, since a wider contact surface is presented to the hand.

Although this improvement has been discussed primarily with reference to my '546 patent, this box-beam structure and widened interior handle surface is obviously readily adaptable to any type of paperboard carrier having an apertured handle. For example, the increase in handle strength from folding the flaps of the hand apertures inwardly and upwardly such that the cut edges contact the ridge of the carrier handle is a significant feature of the instant invention which is readily applicable to any common paperboard carrier. Further, the planar interior surface formed in the upper portion of the hand opening through use of the described creased flap is a feature of the invention contemplated for improving paperboard carriers in general whether or not a beam structure is present in the handle portion.

These and other advantages of the present invention will seem apparent to those skilled in the art, as the description proceeds with greater specificity and clarity with reference to the following drawings.

DETAILED DESCRIPTION

Figure 1:
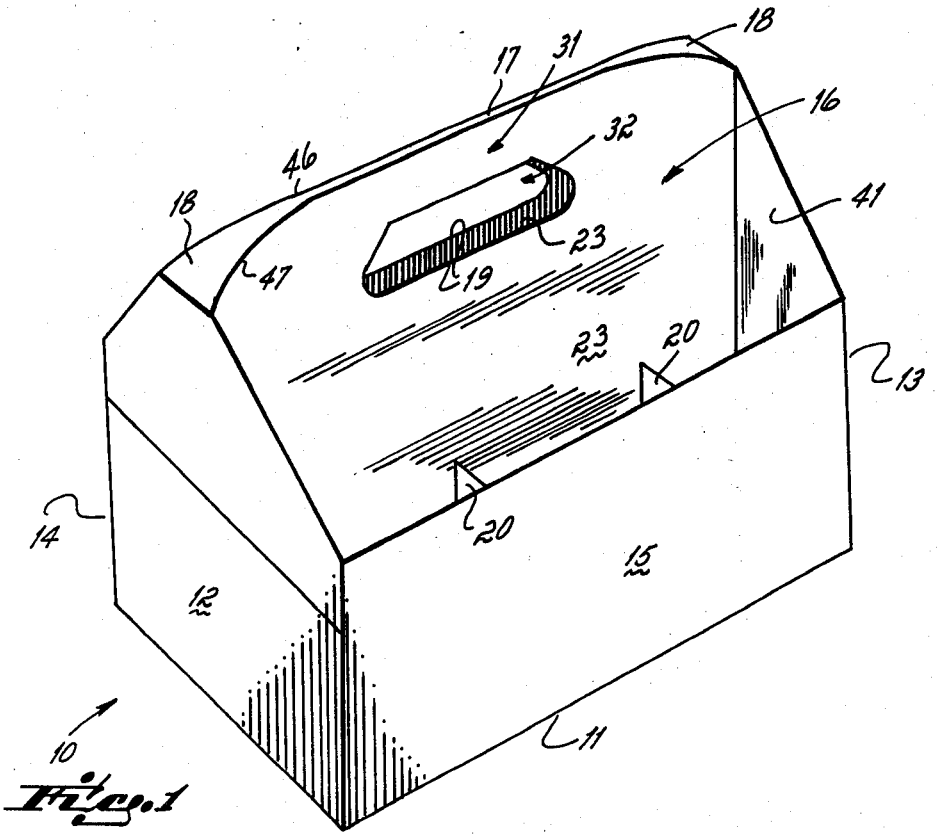
FIG. 1 is a perspective view of a carrier embodying the improved handle of the present invention.

Referring now to FIG. 1, my '546 basket-type carrier is depicted at 10 embodying the handle structure of this invention. The carrier has a bottom wall 11, end walls 12 and 13 and side walls 14 and 15. A center partition 16 extends across the end walls 12, 13 down to approximately the full depth of the carrier. The partition is curved in three-dimensions, as indicated at 18. A flattened ridge of about ¼ inch width is shown at 17, extending between the curved portions 18 at the top of the partition. Hand aperture portions 19 form the hand opening 32 for the handle portion of the carrier 10. Dividers 20 project inwardly from the side walls, 14, 15 to divide the carrier into cells on each side.

Figure 3:
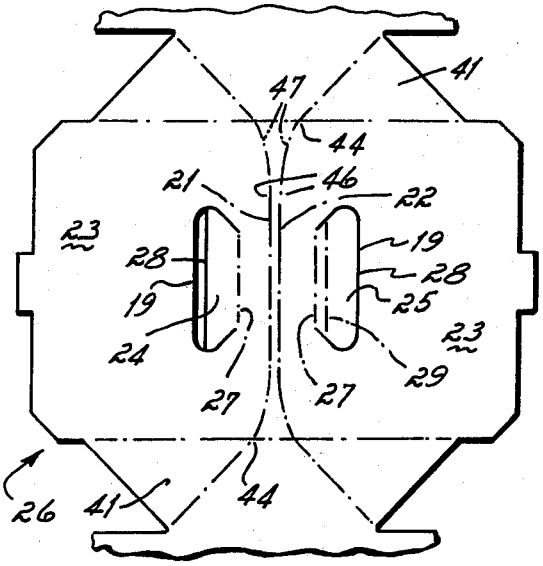
FIG. 3 is a plan view of the top wall portion of the blank from which the carrier is formed.

The carrier is formed from a blank such as that shown in my '546 patent, shown here in part in FIG. 3. The top wall 26 of the blank has two centrally parallel ridge fold lines 21, 22 which are separated by ¼ inch along the mid-part of the carrier, flaring outwardly at the beginning of the curved portions 18. The ridge fold lines are connected to the gusset portions 41 at apexes 44 by curved creases 47 which begin at points 46, which points are spaced from the end walls 12, 13. The curved lines define the generally triangular shaped sections 18.

The top wall 26 has elongated cut-out or hand aperture portions 19 which form the hand opening 32 for the handle portion of the carrier when the top wall is folded down to form the major center panels 23 of the carrier's central partition 16.

Figure 2:
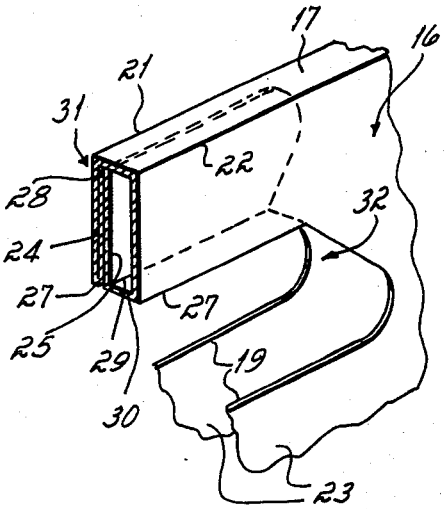
FIG. 2 is an enlarged perspective fragmentary view of the beam structure of the present invention.

Flaps 24, 25 are located in the aperture portions 19, each having a hinge line 27, and a spaced parallel cut edge 28. The width of the flap 24 between hinge line 27 and cut edge 28 is equal to the distance between the hinge line and the nearest ridge fold line 21; the cut edge will thus contact the inner surface of the ridge 17 formed when the carrier is assembled and the flap is folded in and upwardly between the partition portions 23, as shown in FIG. 2. Flap 25 likewise has a cut edge 28 which is spaced from and parallel to its hinge line 27, and which will, in turn, contact the inner surface of the carrier ridge 17 in assembled form. In addition, a flap fold line 29 is provided in the flap 25 which is spaced about ¼ inch from the hinge line 27.

The distance between the cut edge 28 of the flap 25 and the associated flap fold line 29 is equal to the distance between the flap hinge line 27 and the nearest ridge line 22. When flap 25 is folded in and upwardly between the center panels 23, the cut edge 28 will contact the interior of the ridge 17, thereby causing the flap to fold along the flap fold line 29 upon the application of further upward force.

As shown in FIG. 2, a flattened ¼ inch surface 30 is thus created in the upper portion of the hand opening which greatly increases comfort in carrying the loaded carrier.

FIG. 2 further shows the hollow rectangular beam-type structure 31 of the invention formed from the flaps 24, 25 in conjunction with the carrier ridge 17. This improved structure adds strength to the handle portion of the carrier as to direct vertical tension as well as against lateral torques. Further, the formation of the improved handle portion of this invention requires no supplemental gluing or fixing of the flaps. An additional step of folding the flaps 24, 25 in and up is all that is required in the erection of a carrier embodying this handle.

From the foregoing it will be apparent that the beam structure of this invention affords a stronger, more rigid handle portion while providing a broader and more comfortable contact surface within the hand opening of the carrier. While the principle of this improvement has now been disclosed in an illustrative embodiment, there will be immediately obvious to those skilled in the art many modifications of structure, arrangement, proportions or the like, used in the practice of the invention without departing from those principles.

Having described my invention, I claim:

1. In a carrier formed from a blank having a bottom, side walls, and a center partition, the improvement comprising:

first and second flaps partially cut from said upper portion of a carrier blank to form two hand apertures in said blank, each flap having a hinge line and a leading edge, said first flap hinge line permitting said flap to be folded up upon the upper inner surface of one of said center panels, a fold line on the second of said flaps and spaced slightly from said hinge line to form a narrow strip, said second flap being folded up between said center panels with said narrow strip providing a flat contact surface at the upper edge of said hand aperture, the handle portion of the carrier thus formed providing a generally rectangular cross section box beam above said apertures about which a hand can be wrapped.

2. A carrier as in claim 1 in which said flaps have a vertical dimension which causes the free edge of each flap to engage the ridge at the top of said center partition.

3. A carrier as in claim 1 further comprising:

two spaced parallel fold lines in said carrier blank, said fold lines permitting the folding of said carrier blank into two major spaced center panels, which center panels form said center partition for a carrier, said fold lines further creating a narrow flattened ridge along the top of said center partition.

4. In a carrier formed from a blank having a bottom, side walls, and a center partition, and having at least one hand aperture in said blank, the improvement of:

at least one fold line in said carrier blank, said fold line permitting the folding of said carrier blank into major center panels, which center panels form said center partition for said carrier, said fold line further defining a ridge along the top of said center partition, a flap integral with said carrier blank and located within said hand aperture, said flap having a hinge line and a spaced parallel cut edge, a fold line on said flap spaced slightly from and parallel to said hinge line, said flap fold line permitting the folding of said flap to form a planar contact surface within the upper portion of said hand aperture in said carrier when said flap is folded inwardly and upwardly between said major center panels.

5. A carrier as in claim 4 wherein said flap hinge permits said cut edge to contact the upper inner surface of said center partition ridge when said flap is folded inwardly and upwardly between said major center panels.

6. In a paperboard carrier having a two ply center partition, at least one flap struck from one of said partitions to form an aperture through which fingers can pass to create a handle for said carrier, said flap being hinged to said center partition along a hinge line at the upper edge of said aperture and being folded upwardly to lie between said center partitions to contactingly engage the interior upper ridge formed by said two ply center partition.

7. A carrier as in claim 6 in which said flap has a fold line spaced about $\frac{1}{4}$ inch from and parallel to its hinge line to space said plies apart and to form a planar contact surface within the upper interior of said hand aperture.

8. In a paperboard carrier having a two ply center partition in which said center plies are joined at the top along a crease, first and second flaps being cut from said center plies and hinged to respective plies along parallel hinge lines, said flaps forming an opening in said partition, said hinge lines being spaced down from the top of said center partition about $\frac{3}{4}$ inch, said first flap being about $\frac{3}{4}$ inch wide and folded upwardly between said plies and having a free edge in contact with the crease at the top of said center plies, said second flap being about one inch wide and having a fold line spaced about $\frac{1}{4}$ inch from its hinge line and parallel to it to form a narrow strip, said second flap being folded upwardly into the space between said center plies and having a free edge in contact with the crease at the top of said partition, said narrow strip lying horizontally across the top of said opening to form a contact surface which is comfortable to fingers gripping the carrier.

9. A carrier as in claim 8 in which the crease at the top of said center partition is formed by two parallel fold lines spaced apart about $\frac{1}{4}$ inch, thereby creating a box beam above said aperture.

* * * * *